United States Patent [19]

Murphy et al.

[11] 4,036,673

[45] July 19, 1977

[54] METHOD FOR INSTALLING SURFACE COVERING OR THE LIKE

[75] Inventors: Robert E. J. Murphy, Nutley; Laurence F. Haemer, Fairfield; Edward C. Scholl, Tuckerton, all of N.J.

[73] Assignee: Congoleum Corporation, Milwaukee, Wis.

[21] Appl. No.: 668,249

[22] Filed: Mar. 18, 1976

Related U.S. Application Data

[63] Continuation of Ser. No. 429,187, Dec. 28, 1973, abandoned.

[51] Int. Cl.[2] ..... B32B 5/18

[52] U.S. Cl. ..... 156/71; 156/79; 156/290; 156/295; 222/4; 222/394; 260/2.5 E; 260/2.5 L; 260/29.6 R; 264/321; 428/95; 428/195; 428/310

[58] Field of Search ..... 156/71, 79, 290, 295; 264/321; 260/2.5 E, 2.5 L, 29.6 R; 222/4, 394; 428/195, 196, 197, 95, 310

[56] References Cited

U.S. PATENT DOCUMENTS

| | | | |
|---|---|---|---|
| 2,841,205 | 7/1958 | Bird | 156/79 |
| 3,193,406 | 7/1965 | Mittelman | 156/295 |
| 3,240,655 | 3/1966 | Voelker | 156/79 |
| 3,302,362 | 2/1967 | Lang | 52/743 |
| 3,649,325 | 3/1972 | Affeldt | 264/321 |
| 3,705,669 | 12/1972 | Cox et al. | 222/394 |
| 3,765,972 | 10/1973 | Wesp | 156/71 |
| 3,806,385 | 4/1974 | Terry | 156/331 |

*Primary Examiner*—Edward G. Whitby
*Attorney, Agent, or Firm*—Richard T. Laughlin

[57] ABSTRACT

A method for installing a sheet of surface covering material on a substrate surface comprising depositing a quantity of a foamed adhesive to the substrate surface, laying the sheet on the adhesive, applying pressure to the sheet so as to spread the adhesive and cause the adhesive to conform to any irregularities of the substrate surface, and allowing the adhesive to dry, thereby bonding the sheet to the substrate surface. Also disclosed is a packaged foamable adhesive for use with this method.

14 Claims, 2 Drawing Figures

METHOD FOR INSTALLING SURFACE COVERING OR THE LIKE

This is a continuation, of application Ser. No. 429,187, filed Dec. 28, 1973 now abandoned.

This invention relates to a method of installing a sheet of surface covering material on a substrate surface such as a floor surface. More particularly, this invention relates to a method for installing a surface covering material on a floor surface or the like using a foamed adhesive.

BACKGROUND AND OBJECTS

The prior art has suggested many methods for installing a surface covering material on a surface such as a floor surface, wall surface, counter top, ceiling, upholstery substrates or the like. Many types of adhesives or adhesive products have been used, but the type of adhesive used depends to a large extent upon the use to which the surface covering will be subjected, as well as the nature of the surface covering material and the surface being covered. For example, the adhesive used for laying vinyl sheet goods on a concrete floor is substantially different than the adhesive used for applying wall paper to a gypsum-board wall.

Surface covering materials have increased tremendously in popularity in recent years, and the large variety of surface covering materials on the market as well as the many decorative patterns and textures available has added to the popularity of such materials.

One disadvantage of prior art methods for installing surface covering materials has been the skill and craftsmanship required of the installer. This skill is required because frequently the surface covering material is applied to a substrate having an uneven surface contour, and the adhesive must be used to at least partially compensate for the irregularities in the surface of the substrate.

Thus taking floor coverings as an example, the most commonly used method of laying floor covering such as polyvinyl chloride sheet goods and the like has been to meter a suitable mastic to the substrate using a notched trowel to leave a rib or corrugated coating of mastic on the substrate surface. The mastic is allowed to dry for approximately one half-one hour to a tacky condition before the surface covering is applied thereto. A notched trowel is used primarily as a metering device to control the amount of adhesive spread on the substrate. This type of installation requires a skilled worker to lay down an even coating of the mastic.

The surface coverings of the type formed from a polyvinyl halide layer with or without a felt backing layer such as of cellulose or asbestos fibers or of a natural or synthetic foam or sponge layer will transmit any irregularities in the surface to which it is applied to its wear surface. Therefore any irregularities in the sub-floor will appear as such in the finished floor unless the mastic is skillfully applied and rolled so as to even out the irregularities of the adhesive.

In the case of carpeting, much carpeting uses a foam rubber backing sheet laminated to the carpeting to provide a resilient feel as well as to help in eliminating the effects of any sub-floor irregularities. This type of surface covering is most commonly applied by means of a double-faced adhesive tape for bonding the carpeting to the sub-floor.

Another method for installing surface covering which has become quite popular both for carpeting and vinyl surface covering is the use of adhesive-backed tiles which are sold with an adhesive coating on the back and a cover sheet protecting the adhesive backing. For use, the cover sheet is removed and the adhesive coated tiles are pressed into place on the sub-floor.

Another type of system used for installing surface coverings is found both in the floor covering and wall covering field. This consists of a solvent-activatable adhesive-coated sheet of surface covering. Thus, wallpaper having a water activatable adhesive on the back is a common product, and the floor tile having an adhesive which may be activated by an alcohol is also a common product.

In the surface covering industry, any steps of applying an adhesive to the back of the surface covering results in increased cost of the product, thus making it somewhat less desirable, commercially. On the other hand, the use of a mastic which is applied to the sub-floor by skilled workers also increases the installed cost of the surface covering, even though the initial cost of the material may be less.

Accordingly, a primary object of the present invention is to provide a method for installing a surface covering material without requiring costly additional processing of the material.

Another object of this invention is to provide a method for installing a surface covering material which does not require expensive, skilled labor.

Yet a further object of this invention is to provide an easily used adhesive.

Still another object of this invention is to provide a method for installing surface covering material using a foam adhesive.

Still a further object of this invention is to provide a metod for installing surface covering on a sub-floor which is easier and quicker than prior art methods.

Yet another object of this invention is to provide an adhesive which has a longer open time than prior art adhesive compositions.

Still a further object of this invention is to provide a method for applying an adhesive to a sub-surface so as to obtain wide coverage of the sub-surface from a relatively narrow, thick laydown of adhesive.

Yet a further object of this invention is to provide a system for surface covering installation using a foamed adhesive which may readily collapse under the pressure of the surface covering material during installation so as to not leave any unsightly lumps, while providing even coverage of adhesive.

Still another object of this invention is to provide an aerosol package foamed adhesive for use in installing surface covering materials.

Still another object of this invention is to provide a foamable adhesive composition comprising a filled, vinyl acrylic copolymer latex emulsion.

A further object of this invention is to provide an adhesive for surface coverings and the like which has a good resistance to any deleterious effects caused by the plasticizer in the vinyl material.

DESCRIPTION OF THE DRAWINGS

These and other objects and advantages of this invention will become apparent when considered in light of the following description and claims when taken together with the accompanying drawings in which:

DESCRIPTION OF THE INVENTION

The method of the present invention may be used in installing sheet goods such as large widths or tiles of floor coverings of vinyl, vinyl-asbestos, vinyl-foamed vinyl-asbestos, cellulose backed vinyl, jute or foam backed carpeting, and the like; wall coverings such as fabric-backed polyvinyl halide, polyvinyl halide coated paper, and the like.

When used in this specification, the term "vinyl" refers to conventional vinyl resins used in the surface covering industry such as polyvinyl chloride, polyvinyl fluoride, or polyvinyl acetate homopolymers or copolymers of vinyl hadides with vinyl acetate, styrene, etc.

Figure 1:
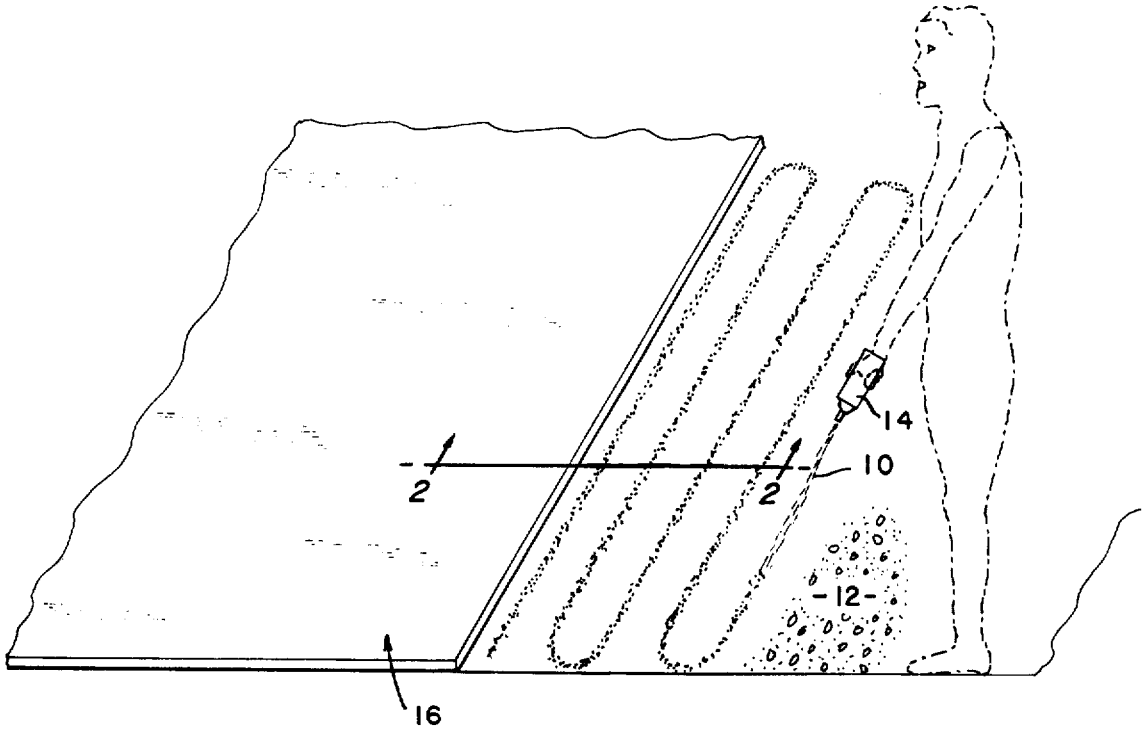
FIG. 1 is a perspective view showing the manner of laying down the adhesive according to the method of this invention.

Taking floor covering as a typical example of the method of the present invention, the installer uses according to this method an aerosol can of a foamable adhesive. The foamable adhesive when discharged from the can under the pressure of a conventional pressurized propellant becomes a foam upon discharge. Thus, as seen in FIG. 1, the installer may apply a continuous, discontinuous, or other suitable bead 10 of foamed adhesive to the sub-surface 12 from the aerosol can 14. The bead 10 as laid down is comparatively thick in relation to its width and to its ultimate thickness after the surface covering is installed. The adhesive may be applied at a rate of about 20 ounces per 80 square feet.

After the area to be covered at a given time is coated with the bead of foamed adhesive 10, the surface covering material 16 is laid down over the foam adhesive. Pressure is applied, either as the weight of the surface covering material, or with an additional pressure source such as a roller or a broom, to the surface covering material 16. The pressure causes the foam bead 10, which was initially comparatively thick, to spread so as to substantially completely cover the sub-surface 12 beneath the surface covering 16. Additionally, the foam is preferably at least partially collapsed by the pressure application so as to bed the surface covering material in the adhesive foam.

Because of the nature of the adhesive foam, it does not tend to flow as a liquid, but does spread readily under the pressure of the surface covering material applied to it. The foam in being spread provides a smooth even finished surface.

The adhesive used is a resinous material which comprises a major proportion of a synthetic resin. Particularly suitable synthetic resins are the acrylic resins, polyvinyl halides, and polyvinyl acetate. Polyvinyl acetate homopolymers, and copolymers of polyvinyl acetate with polyvinyl halides such as polyvinyl chloride or polyvinyl fluoride are particularly suitable. Additionally, arylic resins such as methyl methacrylate and ethyl acrylate and vinyl acrylic copolymers may be used as the adhesive component of the composition. A particularly suitable resin is a vinyl acetate butyl acrylate copolymer latex having a glass transition temperature in the range of + 5° to 15° C. This particular latex is 55% resin solids and has a pH of 4.5 and Brookfield viscosity of 700 cps. The particles are generally anionic in the aqueous latex emulsion and have a size of approximately 0.35 microns. This resin has a density of 9.1 pounds per gallon.

The adhesive composition, also includes a filler and clay fillers are particularly suitable because of their low cost and good properties as fillers. Huber 35 clay has been found suitable in this regard and has a particle size distribution of 30–40% finer than 2 micron and 35–45% coarser than 5 micron. This clay has a Brookfield viscosity at a 70% solids slurry in water of 100–150 centipoise at 20 rpm using a No. 1 spindle at 25° C. In an aqueous slurry, the clay has a pH of about 4.5–5.5. With the filler in the adhesive composition, it is desirable to use a dispersant therefor, since the resin is present in aqueous emulsion. A suitable dispersant is potassium tripolyphosphate.

Also as is conventional in latex emulsions, a small amount of a defoaming agent is preferably included.

The adhesive preferably contains a plasticizer which may also serve as a tackifier for the adhesive. Such plasticizers are well known in the art and include materials such as dibutyl phthalate, dioctyl phthalate, and similar ester-type plasticizers. An additional tackifier may also be included in the adhesive composition, such as for example toluol.

It is also desirable when using a metal aerosol can for the adhesive to include a rust inhibitor in the adhesive composition. Similarly, bactericides for both gram negative and gram positive bacteria may be included in the composition.

Typical formulations of adhesive compositions which may be utilized in accordance with this invention are given in the following examples:

EXAMPLE 1

| | Weight % |
|---|---|
| Water | 17.5 |
| Dispersant (potassium tripolyphosphate - KTPP) | <0.1 |
| filler (Huber 35 clay) | 29.0 |
| vinyl acetate butyl acrylate copolymer1 | 42.0 |
| plasticizer (dibutyl phthalate) | 6.5 |
| tackifier (toluol) | 2.5 |
| defoaming agent (Deefo 97-2) | <1.0 |
| rust inhibitor (Paybo 60) | <1.0 |
| bacteriocide (Cotin 234) | 1.0 |
| bacteriocide (Cosan 1850) | <1.0 |

EXAMPLE 2

| | Parts by weight |
|---|---|
| water | 600.0 |
| KTPP | 3.2 |
| Huber 35 | 1100.0 |
| Colloid 691 (defoamer) | 8.0 |
| Cosan 1850 | 10.0 |
| vinyl acetate butyl acrylate copolymer1 | 1600.0 |
| dibutyl phthalate | 240.0 |
| | 3561.2 |

EXAMPLE 3

| | Parts by weight |
|---|---|
| water | 500.0 |
| PMA 30 (bacteriocide) | 7.0 |
| KTPP | 3.2 |
| Huber 35 | 1100.0 |
| Raybo 60 | 36.0 |
| Colloid 691 | 8.0 |
| vinyl acetate butyl acrylate copolymer1 | 1600.0 |
| toluol | 100.0 |
| dibutyl phathalate | 240.0 |
| | 3594.2 |

EXAMPLE 4

| | Parts by weight |
|---|---|
| water | 130.0 |
| KTPP | .96 |
| Huber 35 | 330.0 |
| 10% PMA 30 | 22.0 |
| Raybo 60 | 10.8 |
| Colloid 691 | 2.4 |
| vinyl acetate butyl acrylate copolymer1 | 480.0 |
| toluol | 30.0 |
| dibutyl phthalate | 72.0 |
| | 1078.16 |

-continued

EXAMPLE 5

| | Parts by weight |
|---|---|
| water | 1500.0 |
| KTPP | 9.6 |
| Huber 35 | 3300.0 |
| Cotin 234 | 90.0 |
| Raybo 60 | 108.0 |
| Colloid 691 | 24.0 |
| vinyl acetate butyl acrylate copolymer[1] | 4800.0 |
| toluol | 300.0 |
| dibutyl phthalate | 720.0 |
| Cosan 1850 | 99.7 |
| | 10,951.3 |

EXAMPLE 6

| | Parts by weight |
|---|---|
| water | 1500.0 |
| KTPP | 9.6 |
| PMA 30 | 21.0 |
| Huber 35 | 3300.0 |
| Raybo 60 | 108.0 |
| Colloid 691 | 24.0 |
| vinyl acetate butyl acrylate copolymer[1] | 4800.0 |
| toluol | 300.0 |
| dibutyl phthalate | 720.0 |
| | 10,782.6 |

EXAMPLE 7

| | Parts by weight |
|---|---|
| water | 150.0 |
| KTPP | .96 |
| Huber 35 | 330.0 |
| Raybo 60 | 10.8 |
| Colloid 691 | 2.4 |
| vinyl acetate butyl acrylate copolymer[1] | 480.0 |
| Cotin 234 | 4.5 |
| toluol | 30.0 |
| dibutyl phthalate | 72.0 |
| Cosan 1850 | 9.97 |
| | 1090.63 |

EXAMPLE 8

| | Parts by weight |
|---|---|
| water | 1500.0 |
| KTPP | 9.6 |
| Huber 35 | 3300.0 |
| Cotin 234 | 90.0 |
| Raybo 60 | 108.0 |
| Colloid 691 | 24.0 |
| vinyl acetate butyl acrylate copolymer[1] | 4800.0 |
| toluol | 300.0 |
| dibutyl phthalate | 720.0 |
| Cosan 1850 | 99.7 |
| | 10,951.3 |

[1]Aqueous latex emulsion, 55% solids

The propellant utilized in the aerosol cans is one or a combination of several of the propellants sold under the trademark FREON These propellants are halogenated hydrocarbons. Freon 12 has been found to be a particularly suitable propellant as has a combination of Freon 12 (dichlorodifluoromethane) and Freon 114 (1,2 dichloro - 1,1, 2,2 - tetrafluoroethane) in a ratio of 10:90 parts to 60:40 parts, and preferably 30:70 parts.

Figure 2:
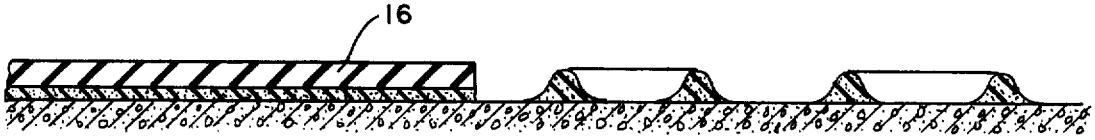
FIG. 2 is a sectional view along line 2—2 of FIG. 1 and viewed in the direction of the arrows.

The nozzle used on the aerosol can is designed so as to emit a comparatively narrow bead of adhesive composition and to thereby prevent overspray of adhesive onto the surrounding area. The foam adhesive beads are preferably laid down at a depth of about ½ - 1 inch, and about 6 inches to 1 foot apart. When the surface covering is applied over these beads, the foam flattens out and at least partially and preferably completely collapses as seen in FIG. 2 thus substantially filling the space between the surface covering material and the substrate. The adhesive layer then has a thickness of about 2–5 mils. If the adhesive is laid down in stripes about 1 inch high and 1 ½ inches wide with stripes about 6 inches apart, the adhesive spreads when the sheet material is applied so as to almost completely eliminate any voids in the adhesive layer.

The presence of the filler in the adhesive composition serves to give the composition sufficient body so as to prevent running of the adhesive as well as provide support for the surface covering. Of course the filler, as well as the particles of the resin must be very finely divided so as to prevent formation of lumps which would create uneveness in the finished surface. The filler is added in accordance with the viscosity of the material so that the adhesive foam as applied does not run. The adhesive composition is a thixotropic gel which readily converts to a liquid having a viscosity in the approximate range of 1500–3500 cps, and preferably in the range of 1600–2000 cps. The viscosity and thixotropy may of course be controlled according to viscosity improving additives. The viscosity of the compositions of examples 1–9 as measured by a Brookfield viscometer with a number 4 spindle at 20 rpm is given in the following table, both after insertion of the spindle and after 5 mintues stirring.

TABLE

| Example | Viscosity after breaking down gel structure with spatula mixing (cps.) | Viscosity after #4 spindle has turned at 20 RPM for 5 minutes (cps.) |
|---|---|---|
| 1 | 1950 | 1950 |
| 2 | 3900 | 3000 |
| 3 | 2250 | 2400 |
| 4 | 2300 | 2300 |
| 5 | 2800 | 2500 |
| 6 | 2800 | 2550 |
| 7 | 2700 | 2200 |
| 8 | 2500 | 2450 |
| 9 | 1850 | 1800 |

The adhesive composition according to this invention has been tested in applying foam backed and felt backed vinyl flooring to wood floor and masonite with very good bond strength and even coating ability. There appears to be no decline in the adhesive bond between the surface covering and the substrate with aging, and the shelf life of the aerosol adhesive can is in excess of one year.

The use of the foam according to the method of this invention greatly extends the "open time" of the adhesive. The open time of prior art adhesives or mastics has generally been approximately ½–¾ hour, while the adhesive composition used in the present invention may have an open time of several hours.

The propellant used in the aerosol can of the foamable composition not only serves to propel the adhesive composition but also foams the composition as it is discharged from the can.

Although the examples indicate a number of components in the adhesive composition, the primary and essential components are the water, filler, resinous adhesive, plasticizer, and tackifier. As indicated previously, the filler is preferably a clay-type filler, and as such, may consist of any of the conventional clays such as talc, bentonite, kaolin, calcium carbonate, etc. The tackifier is generally a solvent such as toluol, isopropyl alcohol, or ethylene glycol. The plasticizer which may also function as a tackifier may be anyone of a large number of typical plasticizers used in conjunction with acrylic homopolymers and copolymers of the thermoplastic type.

The adhesive agent which is preferably a vinyl acrylic copolymer must of course be compatible with both the substrate and the portion of the surface covering material with which it is in contact. A particularly useful adhesive agent is polyvinyl acetate either as a homopolymer or a copolymer with polyvinyl chloride, methyl methacrylate, ethyl acrylate or butyl acrylate.

While this invention has been described, it will be understood that is capable of further modification, and the application is intended to cover any variations, uses and/or adaptations of the invention following in general, the principle of the invention and including such departures from the present disclosures as come within known or customary practice in the art to which the invention pertains, and as may be applied to the essential features hereinbefore set forth, as fall within the scope of the invention or the limits of the appended claims.

What we claim is:

1. A method for installing a sheet of surface covering material on a floor surface comprising:

a. depositing a bead of a foamed latex-based adhesive to a portion of said floor surface, b. laying said sheet on said foamed adhesive while said adhesive is wet, c. applying pressure to said sheet for substantially completely collapsing the foam and spreading said adhesive to cover substantially the entire area of contact of said surface covering and said floor surface and thereby causing said adhesive to conform to any irregularities of said floor surface, and allowing said adhesive to dry, thereby uniformally bonding said sheet to said floor surface.

2. A method as in claim 1 and including:

a. depositing said adhesive to the form of a foam from a propellant pressurized receptacle.

3. A method as in claim 2 and including:

a. depositing said adhesive as a bead having a substantial thickness compared to the thickness of the adhesive layer after pressure application.

4. A method as in claim 3 and including:

a. applying pressure to said sheet so as to spread said adhesive and at least partially collapse said adhesive foam.

5. A method as in claim 1 and including:

a. depositing said foamed adhesive as a bead from an aerosol can.

b. said aerosol can containing a foamable adhesive composition and a propellant c. said propellant causing said foamable adhesive to foam upon discharge from said aerosol can.

6. A method as in claim 5 and wherein:

a. said foamable adhesive composition comprises a major amount of a vinyl acrylic copolymer.

7. A method as in claim 6 and wherein:

a. said foamable adhesive composition comprises a filled vinyl acrylic copolymer emulsion.

8. A method as in claim 7 and wherein:

a. said foamable adhesive composition is a thixotropic gel having a viscosity upon shaking within the range of about 1500–3500 cps.

9. A method for installing a sheet of surface covering material on a floor surface comprising:

a. applying to said floor surface a bead of foamed vinyl acrylic copolymer latex emulsion adhesive composition, b. laying said sheet on said foamed composition while said composition is wet, c. applying pressure to said sheet so as to substantially completely collapse the foam and spread said bead to an even layer, d. drying said adhesive composition, e. thereby adhesively bonding said sheet to said floor surface.

10. A method as in claim 9 and wherein:

a. said pressure application at least partially collapses said foamed composition causes said composition to conform to any irregularities of said floor surface.

11. A method as in claim 10 and including:

a. providing a propellant charged supply of a foamable vinyl acrylic copolymer emulsion adhesive composition, b. applying said foamed adhesive composition to said substrate surface by discharging said foamable vinyl acrylic copolymer emulsion adhesive composition from said propellant charged supply, c. whereby the propellant foams said foamable composition upon discharge.

12. A method as in claim 11 and wherein:

a. said foamable composition includes a vinyl acrylic copolymer latex emulsion, a clay filler, a plasticizer and a tackifier, and b. said propellant is a halogenated ethane.

13. A method as in claim 1 and including:

a. applying said foamed adhesive at a rate of about 20 oz. per 80 square feet.

14. A method for installing a sheet of floor covering or the like on a floor surface comprising:

a. depositing a bead of foamed latex-based adhesive composition from an aerosol type receptacle on said floor surface, b. laying said sheet on said adhesive while said adhesive is wet, c. applying pressure to said sheet while said adhesive is wet so as to substantially completely collapse said foam and spread said bead of adhesive to a uniform layer and cause said adhesive to conform to any irregularities of said floor surface and establish the uniform layer of adhesive, and d. allowing said adhesive to dry, thereby uniformally bonding said sheet to said floor surface.

* * * * *